US007874500B2

(12) United States Patent
Santry

(10) Patent No.: US 7,874,500 B2
(45) Date of Patent: Jan. 25, 2011

(54) SNOW MAKING APPARATUS

(76) Inventor: Charles N. Santry, 16 Clyde St., Chestnut Hill, MA (US) 02167

( * ) Notice: Subject to any disclaimer, the term of this patent is extended or adjusted under 35 U.S.C. 154(b) by 376 days.

(21) Appl. No.: 12/152,975

(22) Filed: May 19, 2008

(65) Prior Publication Data

US 2009/0283607 A1 Nov. 19, 2009

(51) Int. Cl.

| | |
|---|---|
| ***F25C 3/04*** | (2006.01) |
| ***A01G 27/00*** | (2006.01) |
| ***B05B 7/12*** | (2006.01) |
| ***B05B 1/30*** | (2006.01) |
| ***F16K 31/36*** | (2006.01) |

(52) U.S. Cl. ..... 239/14.2; 239/2.2; 239/67; 239/407; 239/569; 239/579; 137/505.14

(58) Field of Classification Search ..... 239/14.1, 239/14.2, 2.1, 2.2, 296, 67, 99, 124, 126, 239/270, 398, 407, 408, 410, 411, 416.4, 239/416.5, 417.3, 417.5, 548, 549, 418–426, 239/433, 436–449, 569–586; 137/206, 209, 137/504.14

See application file for complete search history.

(56) References Cited

U.S. PATENT DOCUMENTS

| | | | | |
|---|---|---|---|---|
| 3,822,825 A | | 7/1974 | Dupre | |
| 3,952,949 A | | 4/1976 | Dupre | |
| 4,749,127 A | * | 6/1988 | Ash | 239/14.2 |
| 5,004,151 A | | 4/1991 | Dupre | |
| 5,823,427 A | * | 10/1998 | Dupre et al. | 239/14.2 |
| 5,979,785 A | | 11/1999 | McKinney | |
| 6,032,872 A | * | 3/2000 | Dupre | 239/14.2 |
| 6,152,380 A | * | 11/2000 | Dupre | 239/14.2 |
| 6,182,905 B1 | * | 2/2001 | Dupre | 239/2.2 |
| 7,311,266 B2 | | 12/2007 | Santry | |
| 7,484,373 B2 | * | 2/2009 | Bucceri | 62/72 |

* cited by examiner

*Primary Examiner*—Len Tran
*Assistant Examiner*—Justin Jonaitis
(74) *Attorney, Agent, or Firm*—Carothers & Carothers

(57) ABSTRACT

A snow making apparatus of the low profile snow gun type or of the tower type having independent and co-extending air and first water conduits supported above ground. Air and first water discharge nozzles are connected to the upper ends respectively of these conduits for producing a plume of atomized water from external interacting air and water discharge under pressure from the air and water discharge nozzles to produce snow in sub-freezing ambient conditions. A second water conduit co-extends with the air and first water conduits and a second water discharge nozzle is connected to the upper end of this second water conduit in the head of the snow gun or tower for discharge of additional water under pressure to ambient atmosphere through this second water discharge nozzle. An air valve is also provided in the head of the snow gun or snow tower and is connected to the second water conduit and the air conduit whereby the air valve disconnects the supply of air under pressure from the air conduit to the air discharge nozzle or nozzles when the air valve is subjected to water under pressure from this second water conduit.

4 Claims, 1 Drawing Sheet

SNOW MAKING APPARATUS

BACKGROUND OF THE INVENTION

This invention relates generally to the art of fluid sprinkling and more particularly to the manufacture of snow. More specifically, the present invention relates to snow making equipment for manufacturing snow on ski slopes and the like.

The present invention pertains to improvements over the snow making towers disclosed in U.S. Pat. Nos. 3,822,825; 3,952,949; 5,004,151 and 5,823,427.

These former inventions for artificially producing snow consist of method and apparatus for making snow through the use of snow towers wherein water is supplied under pressure to a point of discharge above ground level and adjacent the top end of the snow gun where it is discharged through a first water nozzle into the ambient freezing atmosphere in the form of a spray. The spray is preferably a high velocity spray of discreet water particles, sometimes referred to as a fine water spray.

Air is also supplied independently under pressure to a second point of discharge at the top of the snow gun and there discharged through an orifice to form a jet of air which is directed into the aforementioned water spray thereby forming a plume of atomized or nucleated water. This atomized water forms seed crystals in a freezing atmosphere, and through the dwell time of the fall from the snow gun to the ground, forms snow.

U.S. Pat. No. 5,004,151 and U.S. Pat. No. 5,823,427 illustrate the same principals but further increase the efficiency of the snow tower in colder sub-freezing ambient conditions. Additional water nozzles are positioned at the top of the tower to discharge more water in colder sub-freezing ambient conditions. This additional supply of water is independently valved for different ambient temperature conditions.

While these prior art systems are extremely efficient, it is always desirable to provide a more versatile snow making apparatus which is more energy efficient in a variety of ambient temperatures to produce a variety of air to water ratios which were previously unattainable.

SUMMARY OF THE INVENTION

The snow making apparatus of the present invention includes independent and co-extending air and first water conduits having a ground support mount for supporting the structure at or above the ground surface. Air and first water discharge nozzles are respectively connected to the upper ends of these air and first water conduits for producing a plume of atomized water from external interacting air and water discharge under pressure from the air and first water discharge nozzles to produce snow in sub-freezing ambient conditions. A second water conduit is provided and co-extends with the air and first water conduits and a second water discharge nozzle is connected to the upper end of this second water conduit for discharge of additional water under pressure to ambient atmosphere through this second water discharge nozzle. The improvement is provided in the form of an air valve positioned at the upper ends of the conduits and connected to the second water conduit and the air conduit whereby this air valve disconnects the supply of air under pressure from the air conduit to the air discharge nozzle when the air valve is subjected to water under pressure from the second water conduit. Thus in colder sub-freezing ambient temperatures more snow can be manufactured with a reduction in the amount of required supply of air under pressure, which is the most expensive component as between the air supply and water supply. This invention is applicable to lower profile ground snow guns as well as tower mounted snow guns.

With this automatic valving mechanism an increase in the snow production of the snow apparatus is accomplished by starting additional water nozzles, thereby also improving the air to water ratio. In the prior art snow making apparatus, reduction of air flow in the tower, or consumption of air under pressure, has never before been accomplished by automatically valving off the air flow with the increase in water flow. This decreases the air flow resulting in a massive reduction in energy consumption per gallon of water converted into snow. The snow making tower thus becomes more energy efficient in a variety of temperatures as the air valve in combination with the water valving produces a variety of air to water ratios that were previously unable to be obtained with the prior art technology.

The use of additional compressed air externally mixed with the bulk water nozzles of the apparatus allows the snow gun to produce acceptable snow quality in higher ambient temperatures in snow guns using either an internal or an external type nucleating system. The snow making tower of the present invention can use both internal and external nucleation together in a selective manner. External mixing nucleates and cools the water streams and the internal mix nucleation provides additional nucleation, and together they produce a better quality of snow at higher temperatures. Also, if the ambient temperature is sufficiently low, the snow gun may be operated in a totally airless mode.

In order to regulate the flow of water in the second water conduit, a shut off valve is connected to the lower end thereof.

The upper end of the first water conduit is also connectable to a source of air under pressure adjacent a water discharge nozzle therefore with an internal mix nucleator which provides an internal mix of air and water under pressure, instead of just water for discharge through the first or another adjacent water discharge nozzle.

A plurality of the air and first water discharge nozzles may be provided and also a plurality of the second water discharge nozzle may be provided. In addition, additional water, air or water air nozzles may also be connected to the upper end of an additional co-extending conduit for selectively discharging additional water or a water air mixture into the ambient atmosphere at the head of the snow gun.

BRIEF DESCRIPTION OF THE DRAWING

Other objects and advantages appear hereinafter in the following description and claims. The accompanying drawing shows, for the purpose of exemplification, without limiting the scope of the present invention or the appended claims, certain practical embodiments of the present invention wherein

DETAILED DESCRIPTION OF A PREFERRED EMBODIMENT

Figure 1:
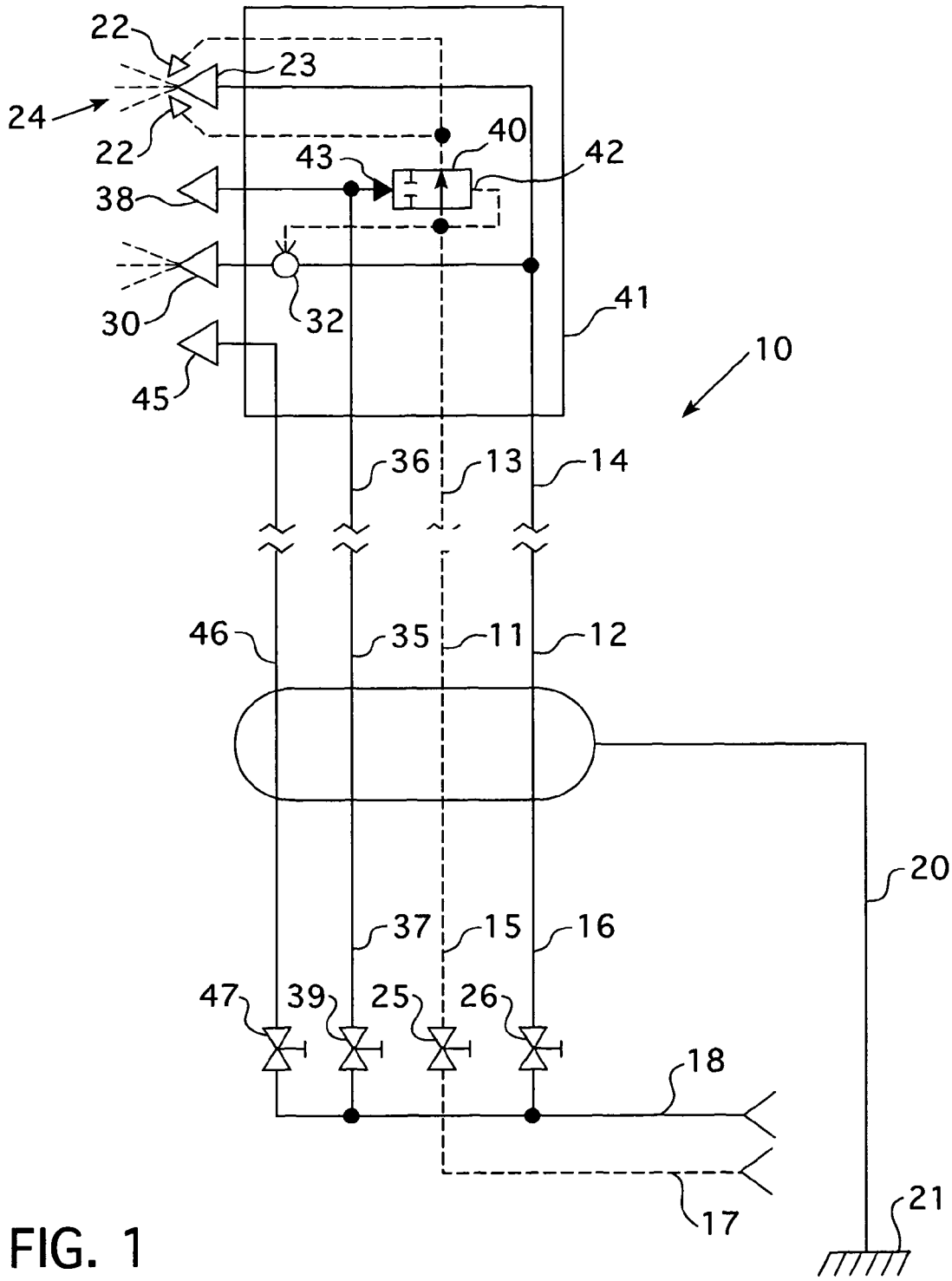
FIG. 1 is a schematic diagram of the snow making tower of the present invention.

While the present invention is applicable to low profile snow guns as well as snow towers extending to heights well above ground, the present invention will nevertheless be explained in connection with a snow making tower embodiment. Referring to FIG. 1, the snow making tower 10 of the present invention includes independent and co-extending air and first water conduits 11 and 12 respectively having upper ends 13 and 14 respectively and lower ends 15 and 16 respectively. The lower ends are respectively connected to sources of air and water under pressure through supply lines 17 and 18. These conduits 11 and 12 constitute a portion of the tower which is supported by a ground support mount 20 secured in the ground 21.

Air discharge nozzles 22 and water discharge nozzle 23 are respectively connected to the upper ends 13 and 14 of air and water conduits 11 and 12 for producing a plume 24 of atomized water from external interacting of air and water discharge under pressure from air nozzles 22 and first water discharge nozzle 23 to produce snow in sub-freezing ambient conditions. A water/air internal mix is also discharged through nozzle 30 as air from line 11 is injected under pressure into water conduit 12 closely adjacent nozzle 30 by internal mix nucleator 32. Typically the air pressure in conduit 11 might be in the area of 100 psi whereas the water pressure within conduit 12 would normally be greater than the air pressure. For this reason, the internal mix nucleator 32 is provided closely adjacent to the nozzle 30 to insure that the greater water pressure does not inject water of greater pressure into the air conduit 11.

Air conduit 11 and water conduit 12 are respectively connected at their bottom ends 15 and 16 through shutoff valves 25 and 26 to air and water under pressure from supply lines 17 and 18.

A second water conduit 35, having upper end 36 and lower end 37, is also provided and co-extends with air and first water conduits 11 and 12. A second water discharge nozzle 38 is connected to the upper end 36 of second water conduit 35 for discharge of water under pressure to ambient atmosphere through second water discharge nozzle 38. Water feed to this nozzle 38 may be regulated by shut off valve 39.

An air valve 40 is also provided at the upper ends of the conduits or tower and is additionally mounted within snow tower head 41 along with all the respective air and water nozzles. Air valve 40 is connected to second water conduit 35 and also independently to air conduit 11 as illustrated whereby the air valve 40 will shift to the right against the pressure of the air at contact point 42 to disconnect the air supply in conduit 11 to the air discharge nozzles 22 when the air valve is subjected to water under pressure from second water conduit 35 as indicated at 43.

Thus, in colder sub-freezing ambient conditions, the expensive use of air discharge through air nozzles 22 may be discontinued, thereby ejecting only water or an internal mix of air and water through nozzles 23 and 30 and additional water only through external nozzle 38.

While a single water or water air nozzle 23 is illustrated, together with single water or air nozzle 30 and water nozzle 38, as an alternative a plurality of each of such nozzles may be provided in the head 41.

Additional water under pressure may be provided to additional nozzle 45 in head 41 through additional water, or air water, conduit 46 which is valved at its bottom end by shutoff valve 47 in order to provide even more versatility in selection of the supply of air and water to the tower head 41 for ambient spraying for different ambient temperature conditions. The snow making apparatus of the present invention is thus very versatile wherein it may provide an external air/water mix only, an external mix of air and water with extra air external nozzles provided, or a combination of an internal or external air water mix.

Conduits 11, 12, 35 and 46 may be run through a single segmented pipe.

I claim:

1. A snow making apparatus comprising:

independent and co-extending air and first water conduits having upper and lower ends and having a ground support mount;

at least one air external discharge nozzle and a first water external discharge nozzle respectively connected to the upper ends of said conduits for producing a plume of atomized water from external interacting air and water discharge under pressure from said at least one air and first water discharge nozzles to produce snow in sub-freezing ambient conditions;

a second water conduit independent of said first water conduit having upper and lower ends and co-extending with said air and first water conduits;

a second water discharge nozzle connected to the upper end of said second water conduit for discharge of water under pressure to ambient atmosphere through said second water discharge nozzle;

an air valve adjacent the upper ends of said conduits and connected to said second water conduit and said air conduit whereby said air valve disconnects the supply of air under pressure from said air conduit to said at least one air external discharge nozzle when said air valve is subjected to water under pressure from said second water conduit.

2. The snow making apparatus of claim 1, including a shutoff valve connected to the lower end of said second water conduit.

3. The snow making apparatus of claim 1, wherein the upper end of said first water conduit is connectable to a source of air under pressure for providing an internal mix of air and water under pressure in the upper end of said first conduit for discharge through said first or another water discharge nozzle connected to the upper end of said first water conduit.

4. The snow making apparatus of claim 1, including additional water or air nozzles connected to the upper end of an additional co-extending conduit for discharging additional water or a water air mixture into ambient atmosphere.

* * * * *